US006007233A

United States Patent [19]

Cairns

[11] Patent Number: 6,007,233

[45] Date of Patent: Dec. 28, 1999

[54] MOBILE CONCRETE MIXING AND DELIVERY SYSTEM

[76] Inventor: Robert W Cairns, 7/21 Macquarie Street, St. Lucia Queensland 4067, Australia

[21] Appl. No.: 08/894,920

[22] PCT Filed: Nov. 24, 1995

[86] PCT No.: PCT/AU95/00778

§ 371 Date: Sep. 3, 1997

§ 102(e) Date: Sep. 3, 1997

[87] PCT Pub. No.: WO96/15889

PCT Pub. Date: May 30, 1996

[30] Foreign Application Priority Data

Nov. 24, 1994 [AU] Australia ..... PM9631

[51] Int. Cl.[6] ..... B28C 5/42; B28C 7/16

[52] U.S. Cl. ..... 366/42; 366/50; 366/68

[58] Field of Search ..... 366/27, 33, 35, 366/38, 41, 42, 45, 46, 50, 68

[56] References Cited

U.S. PATENT DOCUMENTS

| | | | |
|---|---|---|---|
| 2,298,258 | 10/1942 | Ziler | 366/35 |
| 3,456,925 | 7/1969 | Gallagher | 366/27 |
| 4,072,435 | 2/1978 | Coho et al. | 366/50 |
| 4,083,371 | 4/1978 | Beringer et al. | 131/2 |
| 4,551,024 | 11/1985 | Clapp | 366/50 |
| 4,579,459 | 4/1986 | Zimmerman | 366/27 |
| 4,624,575 | 11/1986 | Lantz | 366/16 |
| 4,768,884 | 9/1988 | Elkin | 366/50 |
| 4,810,097 | 3/1989 | Stephens | 366/9 |
| 4,865,227 | 9/1989 | Stephens | 222/135 |
| 5,375,925 | 12/1994 | Elkin | 366/6 |
| 5,486,047 | 1/1996 | Zimmerman | 366/50 |

FOREIGN PATENT DOCUMENTS

| | | | |
|---|---|---|---|
| 472 431 A2 | 2/1992 | European Pat. Off. . | |
| 1 684 044 | 3/1971 | Germany . | |
| 3006682 | 8/1981 | Germany | 366/50 |
| 0662437 | 5/1979 | U.S.S.R. | 366/50 |
| 1 466 661 | 3/1977 | United Kingdom . | |
| 1 566 195 | 4/1980 | United Kingdom . | |
| 2 078 542 | 1/1982 | United Kingdom . | |
| 2 258 412 | 2/1993 | United Kingdom . | |

*Primary Examiner*—Tony G. Soohoo
*Attorney, Agent, or Firm*—Parkhurst & Wendel, L.L.P.

[57] ABSTRACT

There is disclosed a mobile apparatus for mixing and dispensing mixtures from an ingredients container including a hopper with a channel-shaped floor portion containing a screw auger. A cover over the screw auger may be raised so that a gap between the cover and the hopper walls allows metered amounts of ingredients to be conveyed by the screw auger to a separate mixer and a dispenser. The mixer and dispenser can be in the form of a tapering ribbon-blade mixer located in a frusto conical hollow body pivotally, slidably and extendably mounted at the rear of a transport vehicle. The mixer and dispenser can be pivotally mounted to a bracket mounted on rails to move slidably across the width of the transport vehicle.

16 Claims, 7 Drawing Sheets

MOBILE CONCRETE MIXING AND DELIVERY SYSTEM

FIELD OF THE INVENTION

This invention is concerned with a mobile batching and mixing apparatus for mixtures of ingredients such as concrete, cement mortars, road base materials, asphaltic road surfacing compounds, animal feedstuffs and the like and also for transportation of particulate materials.

BACKGROUND OF THE INVENTION

The use of mobile batching apparatus and mobile mixing apparatus for concrete mixtures in particular is well known as is the use of mobile apparatus which have combined batching and mixing functions.

The most commonly employed apparatus for mixing and transportation of pre-mixed concrete and the like comprises a vehicle mounted agitator bowl which receives the ingredients for a concrete mix from a stationary batching plant and, by rotation of the agitator bowl, mixes the concrete mixture prior to and during transit to a discharge site.

Whilst generally effective for their intended purpose, there are a number of disadvantages associated with such mobile agitator bowl mixers. Only a relatively short time is available from the commencement of mixing to on site placement and as the use of chemical retardants can affect concrete quality, generally such use is restricted. This short mixing time thus limits the effective travelling radius of an agitator bowl mixer to a distance which safely can be travelled during the maximum mixing time of the concrete batch. This can be a particular problem in urban areas where a risk of transit delays due to traffic problems is a likelihood. Moreover, if the mobile transit mixer is involved in a traffic accident or otherwise suffers a mechanical breakdown, the entire batch of concrete can be lost and if this is allowed to set in the agitator bowl, this necessitates replacement of the bowl.

Accordingly it is necessary to locate a plurality of stationary batching plants at spaced locations in urban and suburban areas in order to provide effective delivery radii for pre-mixed concrete. Apart from being inefficient in terms of double handling of raw materials, this gives rise to substantial capital overheads and local inconvenience of increased vehicular traffic, dust and noise in the vicinity of batching plants.

As cities grow, town planning and environmental constraints will limit or even reduce the number of batch plants permitted in an urban environment. Already, town planning controls have placed restrictions on the location, days of operation and hours of operation. With growing constraints and competition in the industry, economic considerations have driven organisations towards larger batch plants and transit mixers with necessarily high capital investments and greater operational overheads.

With operational accuracies of larger batch plants more suited to larger transit mix batches, smaller capacity transit mixers are not well served. More importantly however, the capacity to serve a market for small to very small batches of premixed concrete has virtually been eliminated.

Generally speaking, the carrying capacity of larger agitator bowl mixers is usually maximised to carry a pre-mixed batch of about 6.4 cubic meters of concrete.

Where lesser quantities of concrete may be required, smaller agitator bowl mixers may be employed to deliver batches of, say, 0.40 to 2.2 cubic meters.

The main disadvantages of mobile agitator bowl mixers however is that in practice, they should discharge their entire load once on site and this must occur during a relatively short period of time. This can be grossly inconvenient to users of concrete mixes who require less than the predetermined mixer batch size and/or require discharge of small quantities of concrete over a prolonged period of time.

In the supply of ready mixed concrete to a site, it is customary to order an excess of about 10% over that calculated as required by the user as the cost and inconvenience of undersupply or undercalculation is too great. For example, if the quantity required is undersupplied by, say, 0.25 cubic meters, an extra delivery will be required. This can take up to one hour for delivery while a concrete finishing crew is not effectively employed, but as the minimum quantity supplied is normally 0.4 cubic meters this gives rise to wastage. Moreover there exists the risk of a "cold joint" formation in the pour if there is a shortfall in delivery or a delay in delivery of a subsequent batch.

As there are now penalties for disposal of excess concrete dumped on site, it is customary to add a retardant composition to any excess concrete in the agitator bowl and return the excess to the batching plant where it is dumped into a settling pond for separation and treatment of water and recovery of aggregate and cement fines for reworking. Environmental controls associated with re-treatment of unused concrete add substantially to capital costs of a batching plant.

Other problems associated with conventional agitator bowl delivery vehicles is that when rain is forecast or a delivery site is wet or boggy, such vehicles are not permitted on site due to the risk of becoming bogged and all of the attendant problems that arise therefrom and transit mixers cannot be held on stand-by on site.

In order to overcome the disadvantages associated with conventional agitator bowl mixers, there have been many proposals for mobile batching and mixing apparatus employing bulk containers for sand, aggregate, cement powder, water etc, metering devices for each constituent and a mixing and/or dispensing mechanism.

Australian Patent Application No. 27574/88 describes a mobile batching/mixing apparatus comprising a plurality of hoppers, each with a respective metering means for discharging dry ingredients onto a conveyor belt located below the hoppers. The conveyor belt delivers proportioned quantities of dry ingredients to an elevatable batch mixer in the form of a paddle mixer which is tiltable, in an elevated position, to discharge the contents thereof.

U.S. Pat. Nos. 5624577 and 4538916 describe highly sophisticated, purpose built vehicles which operate as mobile batching and mixing apparatuses to deliver variable quantities of pre-mixed concrete as required.

Australian Patents Nos. 575263 and 590101 describe a mobile batching and mixing apparatus which is located at the rear end of a vehicle having a tipping body. The apparatus, which is removably located in the tipping body to release the vehicle for other uses, comprises containers for water and cement powder and a plurality of metering devices for the various components of a concrete mix or the like. Bulk sand and aggregate is fed to respective metering devices under the influence of gravity when the tipping body is raised.

Partial mixing of the dry ingredients is achieved by simultaneous metering into the feed hopper of a mixing and discharge conveyor in the form of a screw auger located in a tubular housing. The dry ingredients and water are introduced at one end of the auger housing and mixing and discharge occurs as a continuous operation.

A particular disadvantage associated with the apparatus of Australian Patents Nos. 575263 and 590101 is that the hopper of the mixing and discharge conveyor must be centrally located below the outlets of the gravity fed metering devices. Accordingly the pivotally mounted inner end of the screw auger is lowered close to the ground surface as the vehicle body tips to feed the metering apparatus.

In order to compensate for this effective lowering of the discharge conveyor and also to provide effective mixing during the continuous mixing and discharge operation, the screw auger is of extended length which extends well above the upper portion of the vehicle body when the auger is in an upright travelling position.

A further disadvantage of this apparatus is that the drive motor for the auger screw is necessarily located at the outer or free end of the auger to avoid contact with the ground surface and consequent damage when the vehicle body is elevated to the required tipping position. The placement of the drive motor at free end of the auger shaft in turn necessitates a discharge opening in the auger body adjacent the free end thereof on an under surface.

Possibly the most serious disadvantage of all of the prior art apparatus referred to above is that none are capable of movement and/or operation in regions of restricted access to areas such as vehicular carparks, basement areas of houses or other buildings, mine tunnels and the like because of limitations on headroom, width, axle load, turning circle etc.

Another disadvantage associated with all of the prior art apparatus referred to above is that each represents a substantial capital investment with high operational overheads due to the physical size and complexity of the apparatus.

SUMMARY OF THE INVENTION

Accordingly, it is an aim of the present invention to overcome or ameliorate at least some of the disadvantages of mobile apparatus for mixing and dispensing concrete or the like.

According to one aspect of the invention there is provided:

a mobile apparatus for mixing and dispensing of ingredients of a mixture, said apparatus comprising;
- mixing means for mixing predetermined quantities of said ingredients of said mixture;
- dispensing means for selectively dispensing said mixture, said mixing means and said dispensing means being located in a hollow body with an inlet opening adjacent said mixing means and an outlet opening adjacent an end of said dispensing means;
- drive means operatively coupled with said mixing and said dispensing means;
- mounting means for said mixing and said dispensing means, said mounting means comprising a track member, a carriage member slidably mounted on said track member and pivot means for pivotal attachment of said hollow body to said carriage means.

According to another aspect of the invention there is provided a mixing/dispensing apparatus for mixing ingredients of a mixture and dispensing of said mixture, said apparatus comprising:

a tapered helical ribbon blade supported on a rotatable shaft in a frusto-conical housing for relative rotation between said shaft and said housing, said housing having an inlet port and an outlet port.

According to yet a further aspect of the invention there is provided:

a mobile apparatus for mixing and dispensing mixtures of ingredients said apparatus comprising:
- one or more container means for containing ingredients of a mixture;
- metering means associated with said one or more container means, and
- a tapered ribbon-blade mixer located within a frusto conical hollow body having an inlet opening and an outlet opening,
- drive means to rotate said ribbon-blade mixer and/or said hollow body, and
- mounting means for mounting said hollow body for slidable movement of said body intermediate opposite sides of a transport vehicle.

Suitably said container means, metering means and conveyor means may be mounted on a transport vehicle such as a truck or lorry.

Suitably at least one of said container means comprises a hopper for particulate material.

If required the hopper may include a sloping floor portion.

The hopper floor portion may slope upwardly from a normally forward portion to a normally rear portion. Alternatively or additionally the hopper floor portion may slope transversely.

Suitably, the metering means may include a cover extending over the length of the conveyor means. The cover may be raised or lowered to meter quantities of ingredients to the conveyor means via the gap between the cover and the sloping portion of the hopper floor. Suitably, said cover may include an extension of perforated material which is pivotally hinged to said cover to prevent settling of said ingredient metered to said conveyor means.

Preferably the raising and lowering of the cover is controlled by hydraulic and/or pneumatic means.

Suitably the cover permits access to the conveyor means for maintenance or cleaning purposes without the need to unload said ingredients.

The metering means associated with said container for a liquid ingredient may comprise any suitable means for delivering a predetermined quantity of said liquid.

Suitably said liquid metering means comprises a liquid storage vessel with a dump valve means.

The container means may include a container for a liquid ingredient of a mixture.

Preferably where accurate metering of liquid ingredient is required said liquid metering means may include a volumetrically controlled pump.

Suitably, the metering means associated with a hopper for particulate material comprises a conveyor means.

Preferably the conveyor means comprises a screw auger however conveyor belt, chain scraper or other means may be used.

The mixing means may comprise paddles, blades, fingers or like members associated with a rotatable shaft.

Suitably the dispensing means comprises a screw auger.

Alternatively, said mixing means and dispensing means may be combined in the form of a screw auger having continuous or discontinuous flights.

Preferably said mixing means and said dispensing means are coaxial for selective operation by said common drive means.

Preferably drive means in the form of an electric or hydraulic motor or drive shaft from power take-off means may be used to rotate the mixing means and dispensing means or said ribbon blade mixer within the hollow body or revolve the hollow body about a stationary mixing means and dispensing means or about said ribbon-blade mixer.

Suitably said drive means is located adjacent said inlet opening of said hollow body and may comprise separate or common drive shafts.

Preferably the hollow body comprises an upper rigid section and a lower resilient section.

Preferably said inlet opening is coverable and is located in an upper portion of said hollow body in the region of the mixing means to receive ingredients from said metering means.

If required said inlet opening may extend substantially along the upper portion of said hollow body.

Suitably, if required said hollow body may include a detachable or telescopic chute extension, with or without a detachable dispensing auger locatable therein.

Suitably the tapering ribbon-blade mixer extends the length of the hollow body.

Preferably the tapering ribbon-blade mixer is located within the hollow body so that there is a minimum clearance between the flights of said ribbon-blade mixer and the lower resilient section of the hollow body. To prevent excessive wear, flights of said ribbon blade mixer may be lined or tipped with neoprene, polyurethane or other material permanently affixed by adhesive, mechanical or other suitable means.

Preferably, said mounting means comprises a track member, a carriage means slidably mounted on said track member and pivot means for pivotal attachment of said hollow body to said carriage means.

Suitably said hollow body is pivotally attached to said pivot means about an upright and/or transverse pivotal axis.

Suitably the position and inclination of said hollow body between an elevated and a declined position may be controlled by fluid ram, mechanical or other means.

Preferably said track member is adapted for mounting transversely at the rear end of said transport vehicle.

If required said track member may extend longitudinally at one side of said transport vehicle.

Retractable and extendable movement of said hollow body may be achieved by further mounting said pivot means to a telescopic extension member such as a scissors link device or other suitable arrangement.

In another version of the invention, the hollow body may be pivotally supported by a telescopic boom. The telescopic boom may comprise a horizontal hydraulically or pneumatically operated telescopic member and a vertical member which may be pivotally mounted adjacent either corner of the rear of a delivery vehicle or mounted on a slidable mounting means which traverses the width of the rear or the lengths of the sides of a delivery vehicle.

BRIEF DESCRIPTION OF THE DRAWINGS

In order that the invention may be more fully understood and put into practical effect, reference will now be made to a preferred embodiment illustrated in the accompanying drawings in which.

DETAILED DESCRIPTION OF THE DRAWINGS

Figure 1:
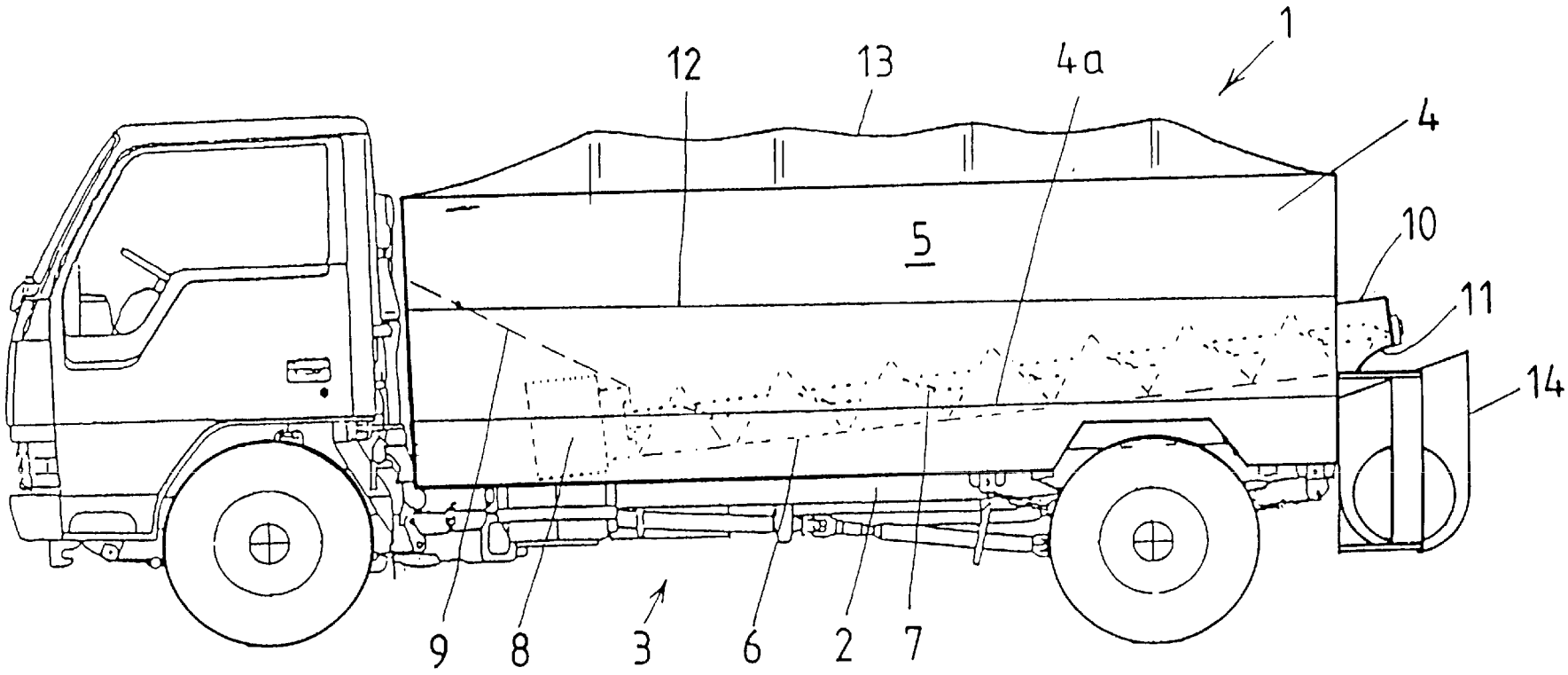
FIG. 1 shows a side elevational view of a mobile concrete mixer and dispenser according to the invention.
Figure 2:
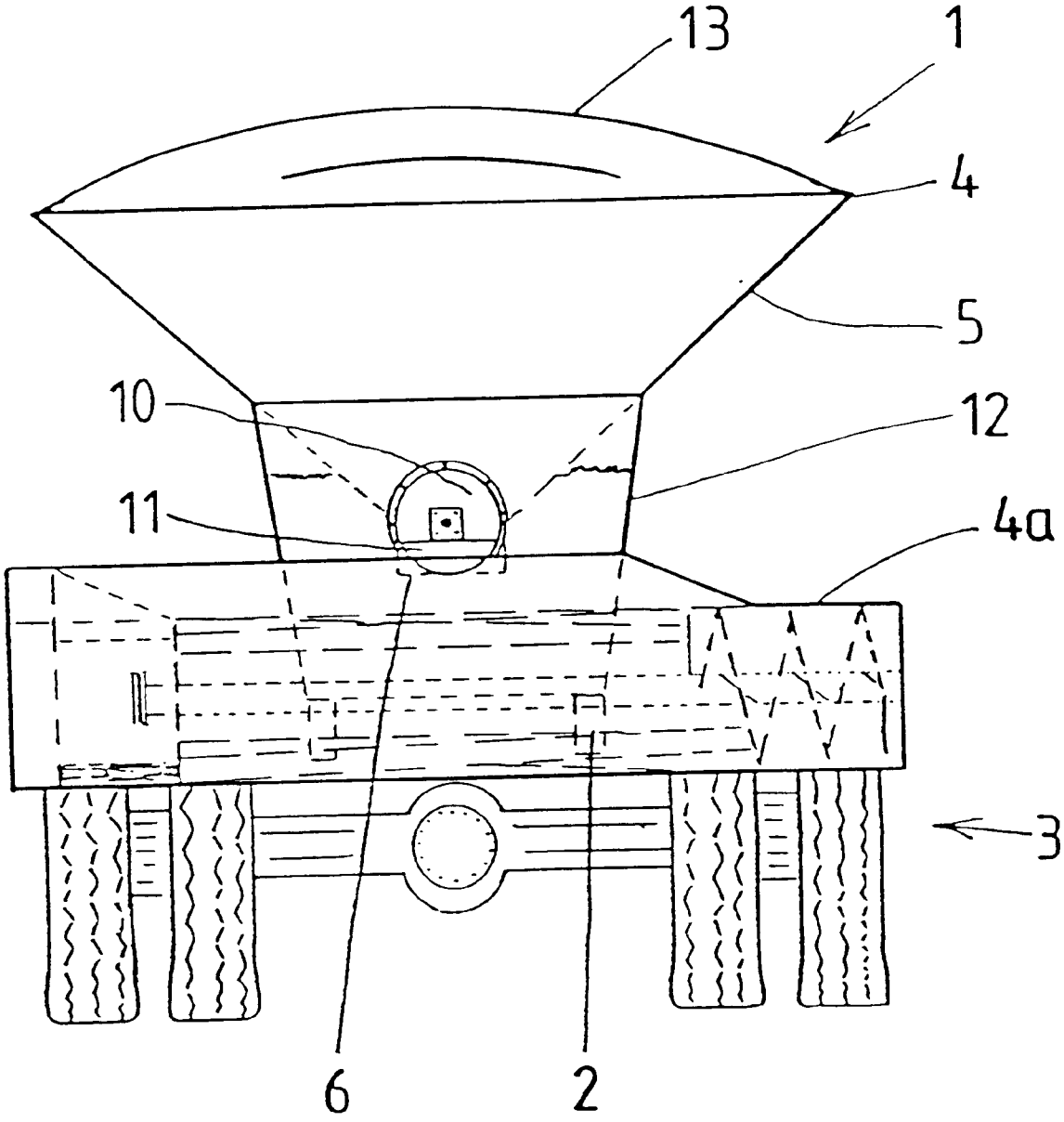
FIG. 2 shows a rear elevational view of the apparatus of FIG. 1

In FIGS. 1 and 2 the apparatus 1 is mounted on the chassis 2 of a transport vehicle 3. As illustrated, the transport vehicle 3 is a 6.5 ton GVM capacity vehicle although for the purposes of the following description, it should be understood that the apparatus may be scaled down to suit a smaller vehicle of say 1 ton or it may be scaled up to suit vehicles of greater carrying capacity including articulated vehicles.

Generally speaking however, the advantages of the invention will be greatest in vehicles having a carrying capacity in the range from 1 to 6 tons due to their more compact construction and reduced headroom requirements.

Apparatus 1 comprises a centrally mounted hopper 4 with inwardly and downwardly sloping side walls 5. Located in a channel shaped floor portion 6, which slopes upwardly from near the front of hopper 4 to the rear thereof, is a screw auger 7.

An hydraulic or electric drive motor 8 is provided forwardly of a sloping front hopper wall 9 and the rear end of the auger shaft is journalled in a housing 10 having a discharge opening 11.

Extending on each side of the lower part of hopper 4 and below is a water tank 12. The base of water tank 12 rests upon and is connected to the chassis rails 2 of vehicle 3.

A retractable canopy 13 is provided at the upper portion of hopper 4 and a platform region 4a is provided along each side of water tank 12.

Mounted at the rear end of apparatus 1 is a mixing and dispensing device 14 for mixing and selectively dispensing a mixture of ingredients.

Figure 3:
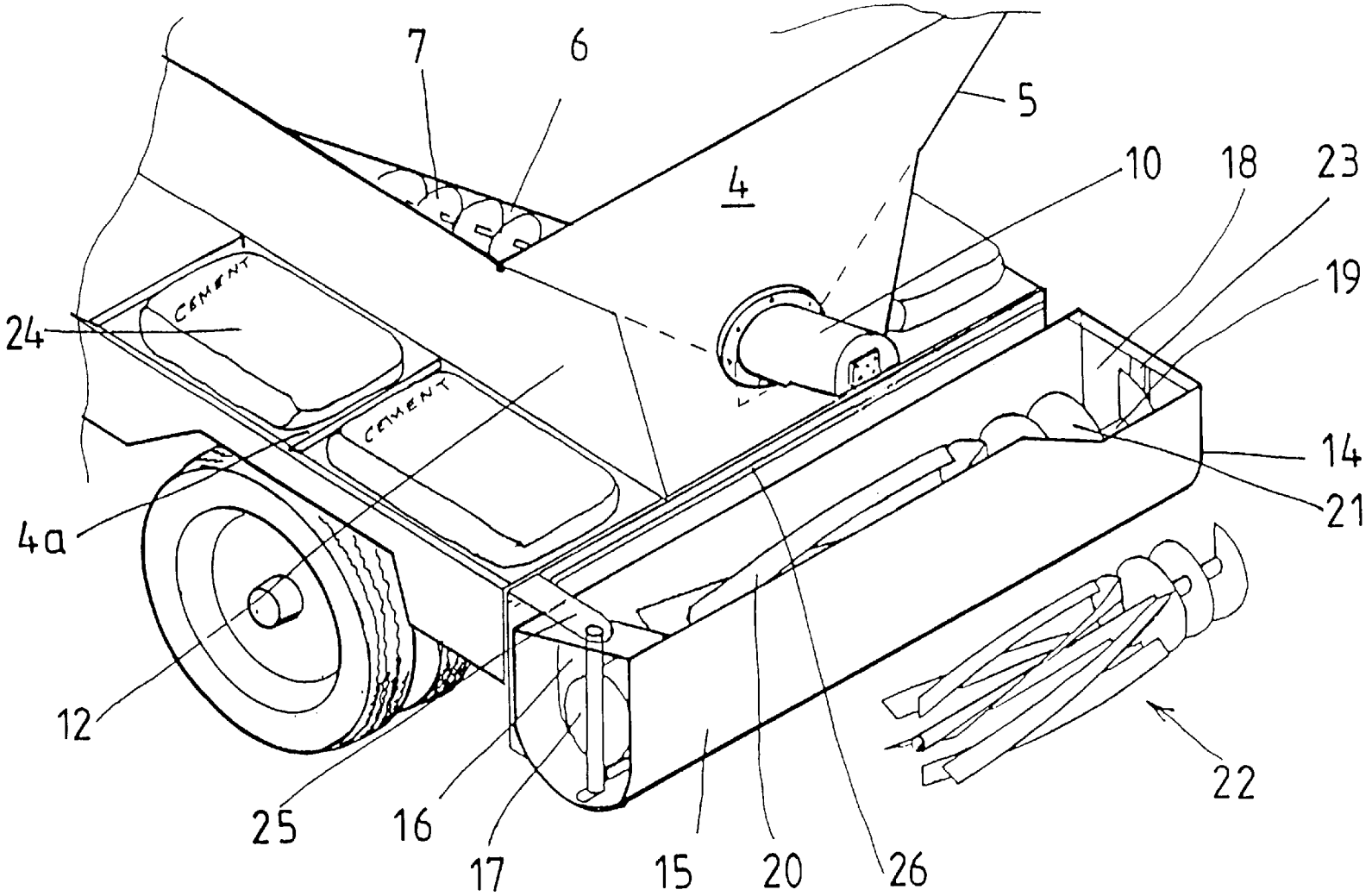
FIG. 3 is a partial rear perspective view of the apparatus of FIGS. 1 and 2.

As shown in FIG. 3, device 14 comprises an open trough-like body 15 having a generally U-shaped cross section. Body 15 is closed at one end by end wall 16 to which an electric or hydraulic drive motor 17 is mounted. At the opposite end of body 15, the omission of an end wall creates an opening 18 for selective dispensing of a mixture.

Drive motor 17 powers a drive shaft 19 having mounted thereon a ribbon blade mixer 20 and a dispensing auger 21. For the sake of clarity the blade mixer 20 and dispensing auger 21 are shown as an assembly 22. The free end (not shown) of shaft 19 is journalled in a bearing (not shown) which is slidable along an upright axis on bracket 23.

As shown in FIG. 3, bagged ingredients 24 of a mixture may be supported for transportation on platforms 4*a* if required.

Body 15 is pivoted about an upright axis on a bracket 25, bracket 25 in turn being slidably mounted on rails 26 for transverse movement from one side of apparatus 1 to the other.

The operation of the apparatus will now be described with reference to a mobile concrete mixing apparatus.

A quantity of sand and aggregate, premixed in predetermined proportions is loaded into hopper 4 and water tank 12 is filled via a filler opening (not shown). A quantity of bagged cement powder is loaded onto platforms 4*a* and vehicle 3 is driven to a site for delivery of site-mixed concrete.

By means of a control panel (not shown) adjacent the rear end of vehicle 3, a predetermined quantity of sand aggregate mix is metered into body 15 by a controlled number of revolutions of screw auger 7. For convenience and simplicity of operation, the control panel may include a metering control for auger 7 calibrated in units equivalent to portions of a bag of cement powder eg. ¼ bag, ½0 bag etc.

A predetermined quantity of sand/aggregate mixture requiring, say, one bag of cement for a required concrete strength of say, 20 Mpa, is metered into mixer 20 and drive motor 17 is actuated for a mixing cycle while the cement powder is added. Suitably, the dry ingredients are mixed for a predetermined time by means of a timing device associated with the control panel.

When the "dry" mixing cycle is complete, the mixer controller apparatus (not shown) actuates a dump valve (not shown) in a cistern-like water holding tank (not shown) which had previously been filled to a predetermined level from water tank 12 by pump (not shown).

For the configuration of mixer/dispenser assembly shown, the assembly may be operated in a counter clockwise direction during a mixing cycle of predetermined duration. During the mixing cycle the curved sweep of the ribbon blades confines the concrete mix towards the mixing region of body 15 and the innermost flight of auger 21 also assists in this regard.

After a mixing cycle of predetermined duration the mixer controller reverses the direction of rotation of the assembly 22 causing the concrete mix to be dispensed via opening 18 in body 15. By mounting body 15 for pivotal movement about an upright axis on slidable bracket 25, body 15 is able to operate as a dispensing chute swingable through 180° and able to dispense the mix on either side of vehicle 3 at a distance equivalent to the length of body 15.

The apparatus described above is particularly suited to mixing and dispensing small quantities of concrete, either for small single batch usage applications or in situation where dispensing of small quantities of concrete over a prolonged period of time are concerned. Moreover, the compact dimensions of the apparatus are such that it is able to enter regions of reduced headroom otherwise denied to conventional mobile concrete mixers and/or dispensers.

It will be readily apparent to a skilled addressee that many modifications and variations may be made to the invention without departing from the spirit and scope thereof.

For example, the hopper 4 may be divided into two or more compartments, each with a respective material metering means such as a screw auger, conveyor belt, chain scraper or the like.

The apparatus may include a storage chamber for cement powder including aeration means and a metering device such as a paddle wheel dispenser or the like with an outlet chute in the region of the mixing portion of assembly 22.

Similarly, the apparatus may include a water metering means such as a volumetrically controlled pump whereby each of the constituent metering means is controlled by a central control means to produce concrete of a specified strength and slump.

In other embodiments, the mixing and dispensing body 15 may be mounted for selective inclination about a transverse axis to permit the discharge end to be raised or lowered as required. Body 15 may also include a detachable or telescopic chute extension, with or without a detachable dispensing auger locatable therein for connection to the free end of assembly 22 for rotation therewith.

The mixing and dispensing assembly 22 may simply comprise a reversible screw auger with continuous or discontinuous flights at the mixing end. Alternatively, the mixing portion and the dispensing portion may be mounted for relative coaxial rotation with a clutch mechanism or planetary gear assembly for selective individual rotation, co-rotation or counter rotation during respective mixing and/or dispensing cycles. In such an arrangement, the body portion 15 may be positioned with its rear end located below the constituent feed outlets to achieve a continuous mixing and dispensing action if required as distinct from a batch process.

Figure 4:
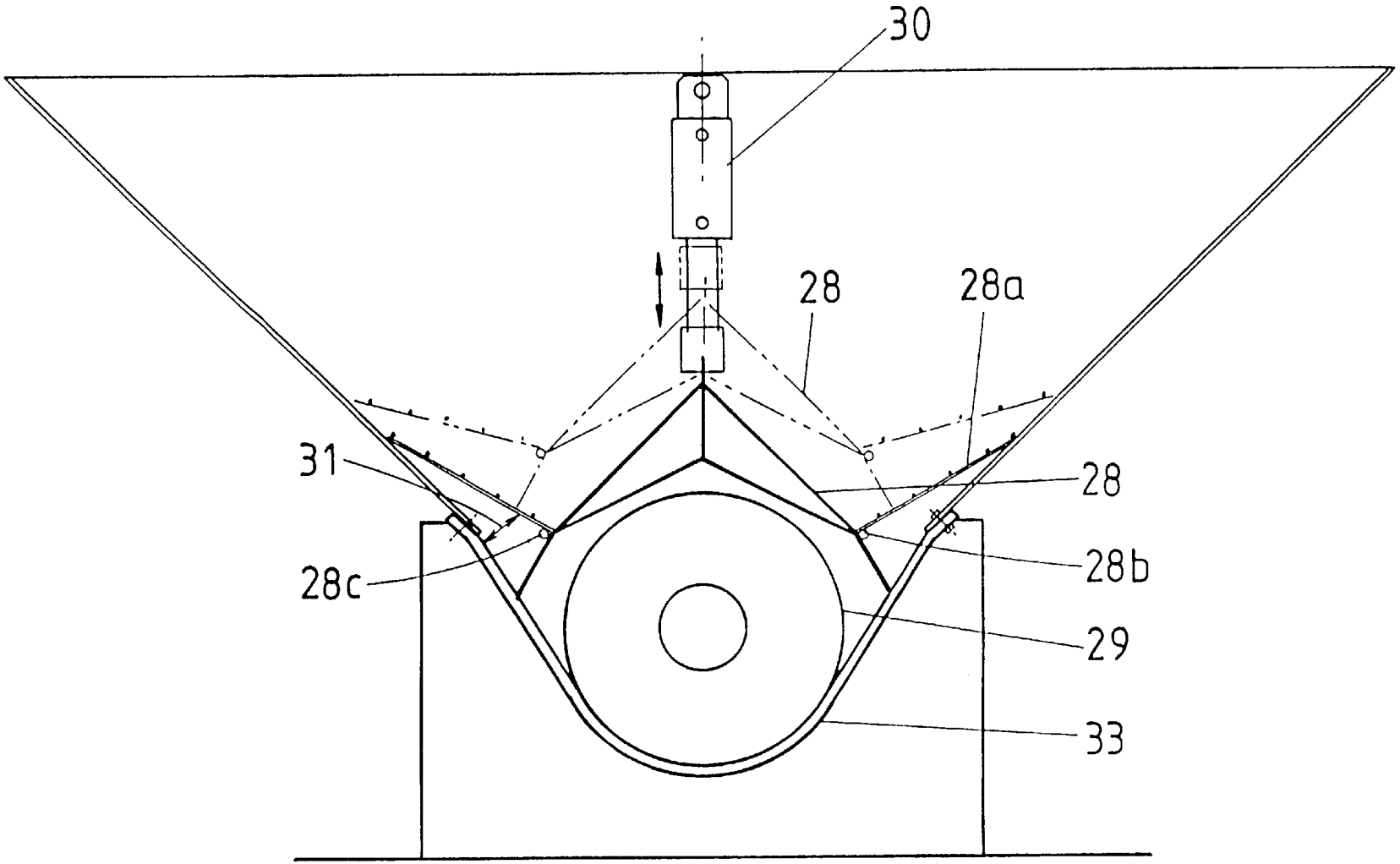
FIG. 4 shows a rear elevation of an alternative form of metering means for ingredients of a mixture.

As shown in FIG. 4 an alternative form of metering means may comprise a rigid cover 28 extending over the length of the screw auger 7. The cover 28 has wing-like extensions 28*a* of steel mesh which are pivotally attached to cover 28 by pivotal connections 28*b* and 28*c*.

The cover 28 is attached at either end to vertically mounted fluid powered rams 30 and may be raised or lowered by independently or synchronously operating the fluid powered rams.

The resulting gap 31 between the cover 28 in the raised position as shown in phantom and the hopper floor 33 permits a controlled flow of particulate materials to the screw auger 7. The quantity of ingredients can be metered by controlling the width of the gap 31 during operation of auger 7. The lowermost region of the screw auger 7 is in close proximity to the hopper floor 33 which is fabricated of resilient flexible sheet material such as natural or synthetic rubber or elastomeric materials such as semi-rigid polyurethane. By restricting the region of contact between the auger and the hopper floor and also by virtue of the resilient floor material, jamming and/or damage to the auger by particles of aggregate is avoided.

In use, after a predetermined quantity of particulate material is metered into the screw auger 7 via gap 31 and the cover 28 returned to its closed position, the screw auger conveys the entire quantity of particulate material to the mixer dispenser leaving the region between the cover 28 and the hopper floor 33 free of particulate material. Accordingly when the vehicle travels from site to site, compaction of the particulate material in the region of the screw auger 7 is prevented. Such compaction can lead to drive motor overload (and damage) or otherwise a substantially stronger motor would be required to drive the screw auger.

A particular advantage of cover 28 is that in the event that auger 7 requires maintenance, the auger screw can be removed from the base of the hopper without first having to manually empty the contents of the hopper.

The steel mesh wing-like extensions 28*a* serve in use to prevent uneven flow of particulate material from the hopper 4 to the auger 7. As cover 28 is raised to permit flow of particulate material to the auger 7 via gap 31, the pivoted wing-like extensions 28*a* are lifted thus disturbing the mass of particulate material thereabove to prevent localised bridging or compaction within the hopper 4.

Moreover, the auger cover 28 not only serves to prevent bridging of the particulate mixture in the hopper, it may be used to control the flow of material to the auger. Selective use of the cover 28 prevents the auger from flooding thereby permitting the use of a larger auger diameter, lower rotational speed, less powerful drive system and a less robust auger construction.

Figure 5A:
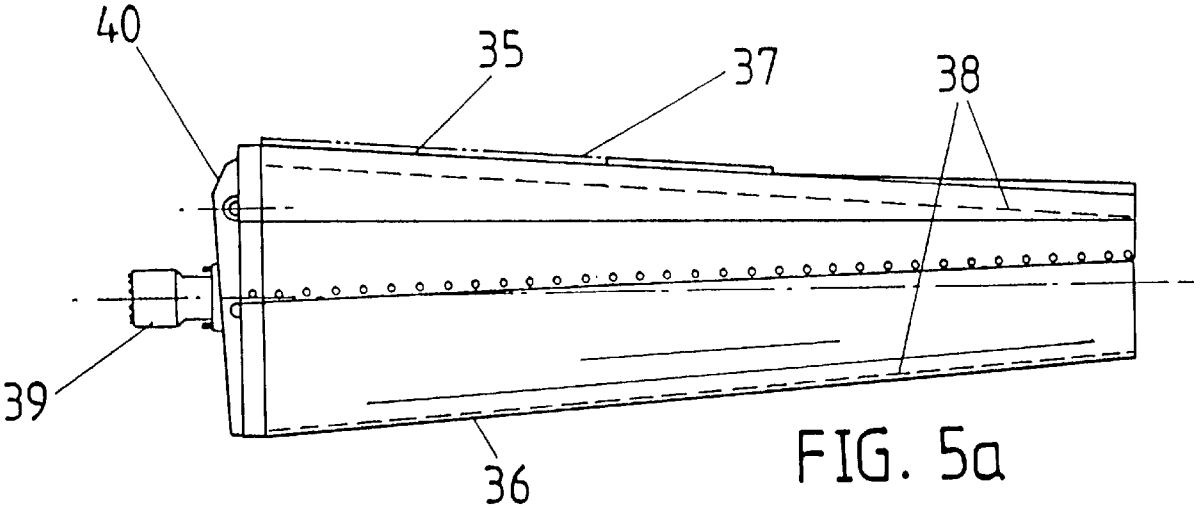
FIGS. 5*a*, 5*b* and 5*c* respectively show a side elevation, top plan and end elevation of a further combined mixing and dispensing apparatus according to the invention.
Figure 5B:
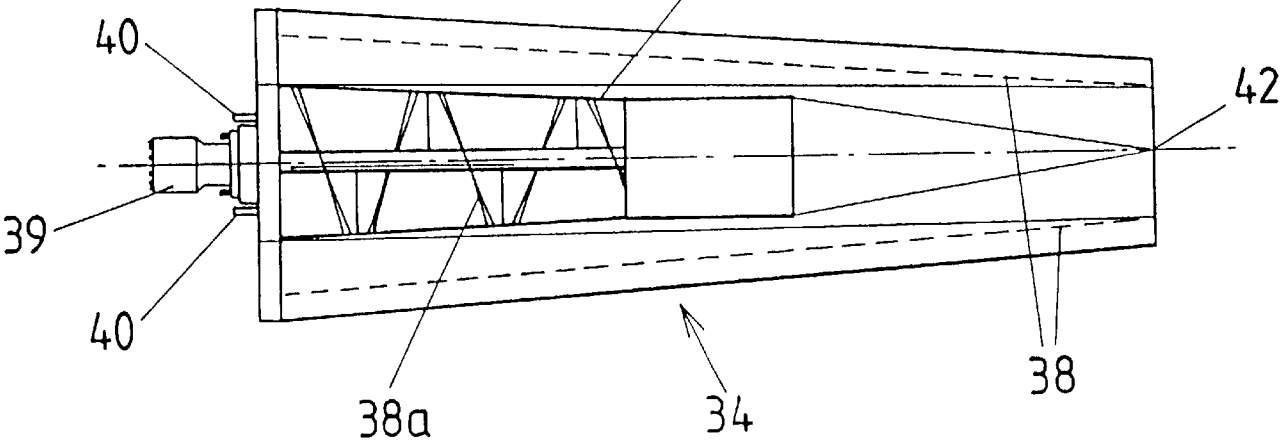
Figure 5C:
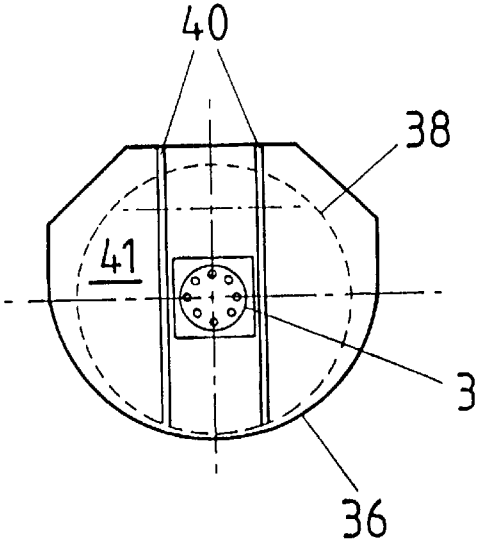

FIGS. 5*a*, 5*b* and 5*c* respectively show a side elevation, top elevation and end elevation of an alternative aspect of the invention which comprises a combined mixing and dispensing apparatus including a body portion 34 having an upper portion 35 fabricated from rigid metal sheeting such as stainless steel and a lower portion 36 fabricated from flexible or resilient sheet material such as natural or synthetic rubber or elastomeric materials such as semi-rigid polyurethane.

There is provided in the upper portion a coverable opening 37 to receive ingredients for mixing.

Located within and extending the length of the body as indicated by the broken lines 38*a* in all views is the outline of a tapered ribbon-blade mixer 38 shown partially in FIG. 5*b*. The tapered ribbon-blade mixer 38 is located within the body so that there is a minimum clearance between the flights of the mixer blades and the lower flexible portion of the body 36.

Also shown attached to the body is a hydraulic motor 39 used to drive the ribbon-blade mixer. On either side of the hydraulic motor are brackets 40 which are attached to the body for pivotal mounting purposes.

Figure 6:
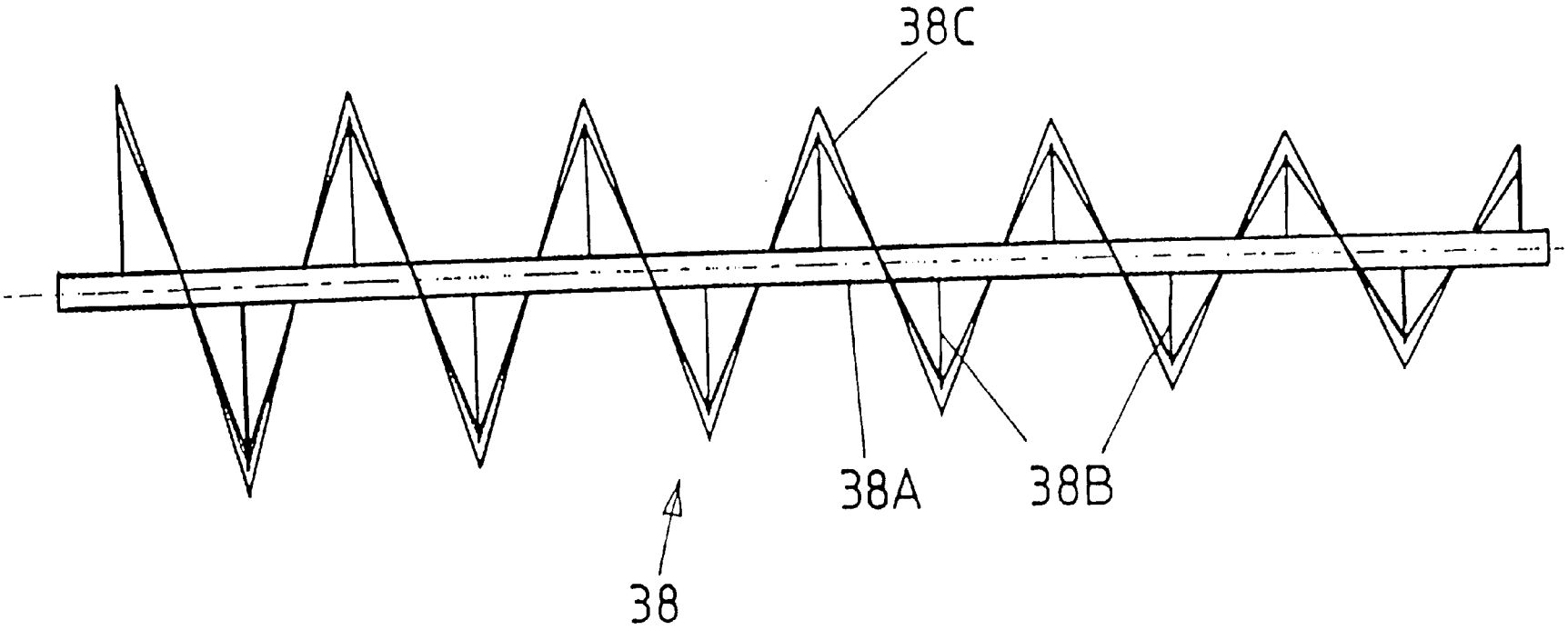
FIG. 6 shows a side elevation of the tapered ribbon-blade mixer of the apparatus of FIGS. 5*a*, 5*b* and 5*c*.

Referring to FIG. 6 it can be seen that the tapered ribbon-blade mixer 38 is comprised of a central shaft 38*b* to which are attached radial support members 38*c* to which support the ribbon-blade member 38*d*. The ribbon blade mixing/dispensing apparatus to one aspect of the invention differs from conventional ribbon blade mixers in that it is generally frusto-conical in shape with the discharge and located at its narrowest diameter.

Ribbon blade mixers generally sweep a cylindrical volume in a trough-like chamber having a semi-circular bottom portion. Although effective as mixers conventional ribbon mixers are poor materials conveyors and thus are not used for this purpose. A screw auger having solid flights is effective as a conveyor but is a poor mixer as it tends to convey a mass of material without subjecting it to any shear forces.

With this aspect of the invention, an efficient mixing function is achieved towards the larger end of the body with limited conveying whereas a more efficient conveying function is achieved towards the smaller open end of the body. This is due to the smaller blade area when compared to the cross sectional area of the body towards the larger end which is better suited for the mixing function. Conversely, the conveying function is more efficient at the smaller open end of the body due to the relatively larger blade area when compared to the internal cross sectional area.

As the helical blade of the tapered ribbon blade mixer has a relatively small surface area compared with a screw auger, its power requirements are considerably less. To avoid undue wear on the relatively thin blade flight, the flight is manufactured from hardened steel or includes wear resistant wear faces. Conveniently, the blade includes a wear resistant polymeric sheath such as an extruded polyurethane or synthetic rubber material which may be attached to the flight by an adhesive or the like.

The largely self cleaning nature of the mixer/dispenser with a combination of a rigid upper portion and a flexible lower portion allows any small amounts of residual mixture to be left in the body without the necessity of washing out the body between mixes. A thin film of any residue which may have hardened against the flexible lower portion is broken up by new particulate matter in a successive mixing.

Figure 7:
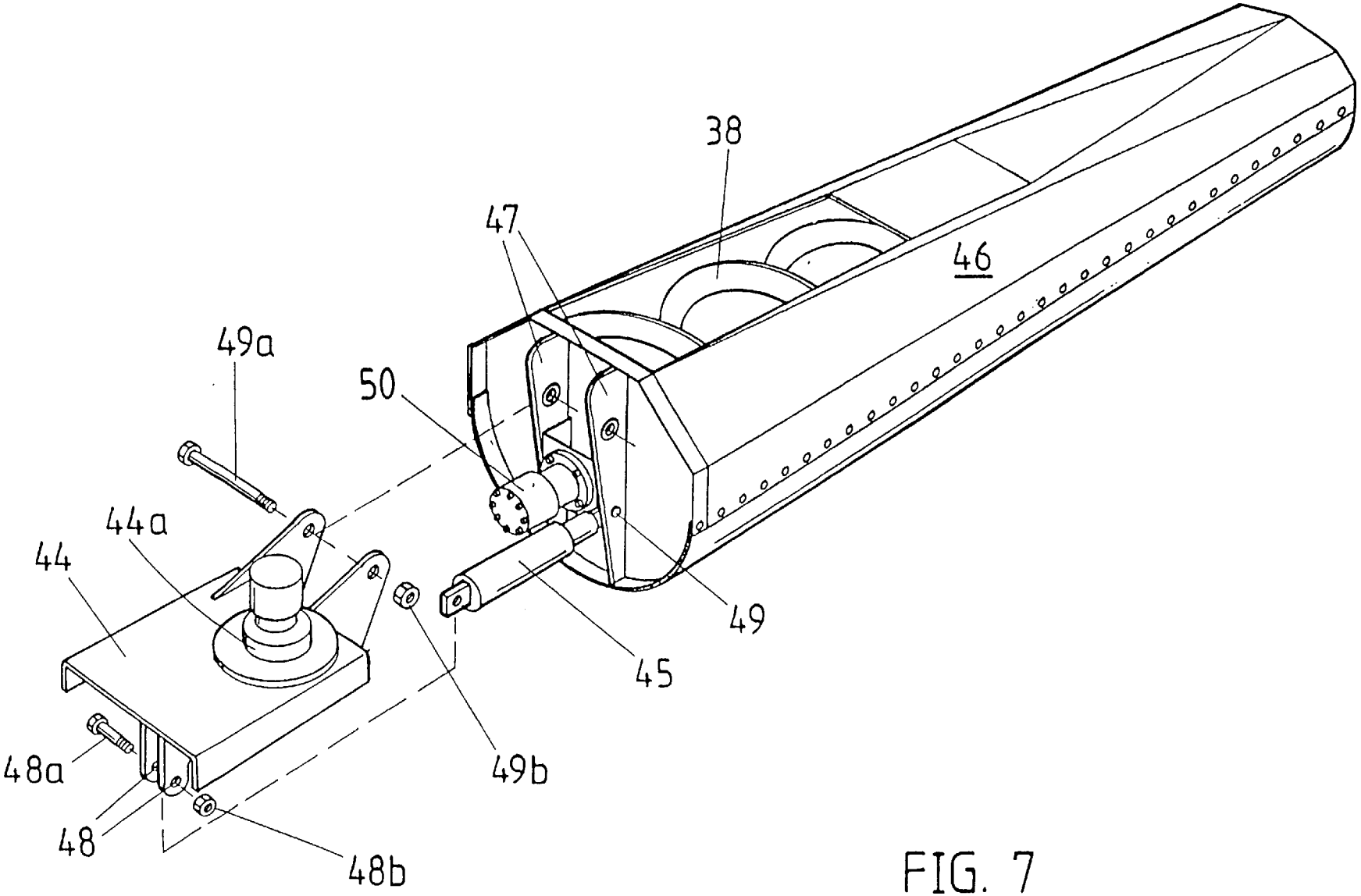
FIG. 7 is a partial side elevational view of the mixer/dispenser of FIGS. 5*a*, 5*b* and 5*c* showing a mounting arrangement.

Referring to FIG. 7 it can be seen that the pivotal mounting means 43 for the apparatus of FIG. 5*a*, 5*b* and 5*c* comprises a mounting member 44 to which a fluid powered ram 45 is attached.

Attached to the body 46 are brackets 47 which are pivotally attached along a transverse axis to the mounting member 44 by a high tensile steel bolt 49*a* and locknut 49*b*. The fluid powered ram 45 is pivotally attached to the mounting member 44 at pivot points 48 by a high tensile steel bolt 48*a* and locknut 48*b* and to the body 46 by pin 49.

There is also attached to body 46 a hydraulic motor 50 which is used to drive the tapered ribbon-blade mixer 38.

Attached to the mounting member 44 is an upright bearing housing 44*a* which permits the body 46 to pivot about an upright axis for positioning purposes when dispensing a mixture. To permit transverse movement of the body 46 from one side to the other of a transport vehicle, the housing 44*a* is mounted to a carriage member which is slidably mounted on tracks (not shown).

In use, the extension of the fluid powered ram permits selective elevation and lowering of the body. Mixing of ingredients may be carried out in the elevated position and then dispensed as the body is lowered.

It will be apparent to a skilled addressee that, with appropriate modifications, the apparatus may be mounted on retractable legs, a skip, trailer or the like to free a transport vehicle for other purposes. For operation independent of a transport vehicle, the apparatus may include an integral power plant or a portable power plant for electric and/or hydraulic power. Similarly, the apparatus may be adapted for use with a variety of mixtures such as animal feedstuffs, seeded and fertilised top dressing mixtures for agricultural use, road base mixtures, bituminous or asphaltic road surfacing materials, explosives compositions such as ammonium nitrate/fuel oil mixtures and the like.

In other embodiments, the metering and/or mixing and/or dispensing augers may be associated with flexible walls of rubber or plastics materials to avoid jamming in the event that an aggregate particle lodges between the edge of the auger flight and the auger wall. The dispensing auger may include a tubular body at the dispensing end to facilitate pressurised dispensing or operation with the dispensing end of the auger in an elevated position.

In a very simple, inexpensive embodiment of the apparatus, it may comprise a rail assembly mounted transversely at the rear of a vehicle tray or tipper body with the mixing/dispensing apparatus pivotally attached to a carriage slidably mounted on the rail assembly. Premixed sand and aggregate may be stored on the tray or in the tipper body in bulk or in containers together with containers for water and cement powder in bags or in bulk. The ingredients of the mixture may be metered into a feed hopper associated with the mixing apparatus by suitable metering means or simply by a shovel or the like.

In yet another simple embodiment of the invention, the mixing/dispensing apparatus may be mounted for slidable and pivotal movement transversely at the rear of a conventional concrete agitator bowl vehicle. In this arrangement, the agitator bowl may contain a dry mix of sand and aggregate or even a dry mix of sand, aggregate and cement powder. On site, cement powder and/or water is added to the mixing/dispensing apparatus for selective batch or continuous production of quantities of concrete.

When mounted to a mobile apparatus the mounting means may comprise a telescopic linkage between the carriage and the mixer/dispenser to provide an even greater flexibility of use. Preferably however the transverse rail assembly which supports the slidable carriage may be mounted on extendable beam members slidably extending along opposite sides of the vehicle chassis or body.

To illustrate the flexibility and adaptability of the apparatus, the assembly of FIGS. 1–3 may be adapted to facilitate removal of housing 10 by means of a quick coupling device and replacement thereof with a cement powder container. The cement powder container includes a metering device such as a paddle wheel dispenser operatively coupled to the electrical and/or hydraulic controls for the apparatus for accurate metering of cement powder with the sand/aggregate mix to the feed hopper of the mixing apparatus.

The apparatus according to the various aspects of the invention is readily mountable on four or six wheel drive vehicles or a tracked vehicle for use in difficult site conditions and is particularly suitable for operation in remote areas beyond the operational limits of conventional ready mixed concrete delivery vehicles. With appropriate modifications, the apparatus is considered to be applicable to civil emergency and military use for, say, rapid repair of damaged roadways and concrete runaways using rapid setting cement, sand bag filling and the like. With this apparatus, relatively small craters which could otherwise render a roadway or runway unusable can be repaired and the roadway or runway restored to operational status within a very short period of time.

A particular advantage of the present invention over similar prior art batching and mixing apparatus is that it can be constructed simply and inexpensively yet with sufficient simple control mechanisms for consistent concrete quality even with unskilled operators. Unlike conventional agitator bowl concrete delivery vehicles which are "tied" to a "mother" batch plant and thus must return empty from each delivery trip, the apparatus according to the present invention is able to refill with sand/aggregate, cement powder and water at a variety of sources thereby improving operational efficiency.

I claim:

1. A mobile apparatus for mixing and dispensing of ingredients of a mixture, said apparatus comprising:

a rotatable mixer for mixing predetermined quantities of said ingredients of said mixture;

a rotatable dispenser for selectively dispensing said mixture, said mixer and said dispenser being located in a hollow body with an inlet opening adjacent said mixer and an outlet opening adjacent an end of said dispenser;

a drive motor operatively coupled with said mixer and said dispenser; and a mounting member for supporting said mixer and said dispenser, said mounting member comprising a track member, a carriage member slidably mounted on said track member and a pivot for pivotal attachment of said hollow body to said carriage member.

2. A mobile apparatus as claimed in claim 1 having one or more containers for containing ingredients of a mixture and an ingredient metering device connected with the interior of at least one of said one or more containers.

3. A mobile apparatus as claimed in claim 2 wherein said one or more containers further includes a hopper for particulate material.

4. A mobile apparatus as claimed in claim 3 wherein said one or more containers further includes a liquid container for a liquid ingredient of a mixture.

5. A mobile apparatus as claimed in claim 2 wherein said metering device comprises a screw auger.

6. A mobile apparatus as claimed in claim 5 wherein said metering device comprises a cover movable between an open and a closed position to permit, in use, a selective flow of particulate material from said one or more containers to said screw auger.

7. A mobile apparatus as claimed in claim 1 wherein said mixer and said dispenser rotate about a common axis.

8. A mobile apparatus as claimed in claim 1 wherein said track member is mounted transversely of a longitudinal axis of a transport vehicle.

9. A mobile apparatus as claimed in claim 8 wherein said track member also extends around one or both sides of a transport vehicle parallel to said longitudinal axis.

10. A mobile apparatus as claimed in claim 1 wherein said mounting member is extendably mounted to said transport vehicle.

11. A mobile apparatus as claimed in claim 1 wherein said mixer and said dispenser comprise a tapered helical ribbon blade supported on a rotatable shaft in a frusto-conical housing for relative rotation between said shaft and said housing, said housing having an inlet port and an outlet port.

12. A mobile apparatus as claimed in claim 11 wherein said inlet port is adjacent a larger diameter end of said housing and said outlet port is adjacent a smaller diameter end of said housing.

13. A mobile apparatus as claimed in claim 11 wherein said housing comprises a lower resilient wall portion.

14. A mobile apparatus as claimed in claim 11 wherein said ribbon blade comprises a wear resistant material.

15. A mobile apparatus as claimed in claim 14 wherein said ribbon blade comprises a removable sheath of flexible wear resistant polymeric material.

16. A mobile apparatus as claimed in claim 11 wherein a drive motor is associated with said shaft adjacent said inlet port.

* * * * *